United States Patent [19]

Adams

[11] 4,019,450

[45] Apr. 26, 1977

[54] FEED REGULATOR LOCKS

[75] Inventor: Kenneth Douglas Adams, Madison, N.J.

[73] Assignee: The Singer Company, New York, N.Y.

[22] Filed: Aug. 12, 1976

[21] Appl. No.: 713,953

[52] U.S. Cl. ..... 112/215

[51] Int. Cl.[2] ..... D05B 27/02

[58] Field of Search ..... 112/215, 216

[56] References Cited

UNITED STATES PATENTS

| | | | |
|---|---|---|---|
| 3,527,183 | 9/1970 | Szostak | 112/215 |
| 3,534,696 | 10/1970 | Willenbacher et al. | 112/215 |
| 3,834,334 | 9/1974 | Adams | 112/215 X |
| 3,921,552 | 11/1975 | Daman et al. | 112/215 |

*Primary Examiner*—George H. Krizmanich

*Attorney, Agent, or Firm*—Edward L. Bell; Robert E. Smith; Edward P. Schmidt

[57] ABSTRACT

A feed regulator shaft lock for a sewing machine operative during the feed of a work material to insure retention of a selected feed against feed back of forces from the feed dogs. A radially functioning cam is supported on a feed shaft in timed relationship to a feed lift cam also supported thereon. A brake member is affixed to a feed regulator shaft, on which a feed regulator is also supported for selective variation thereof by a manual control or by a cam. A shiftable member extending between the cam on the feed shaft and the brake member on the feed regulator shaft may be urged by the cam into pressure contact with the brake member during that portion of the sewing cycle when feed of the work material is effected.

4 Claims, 6 Drawing Figures

Fig. 5
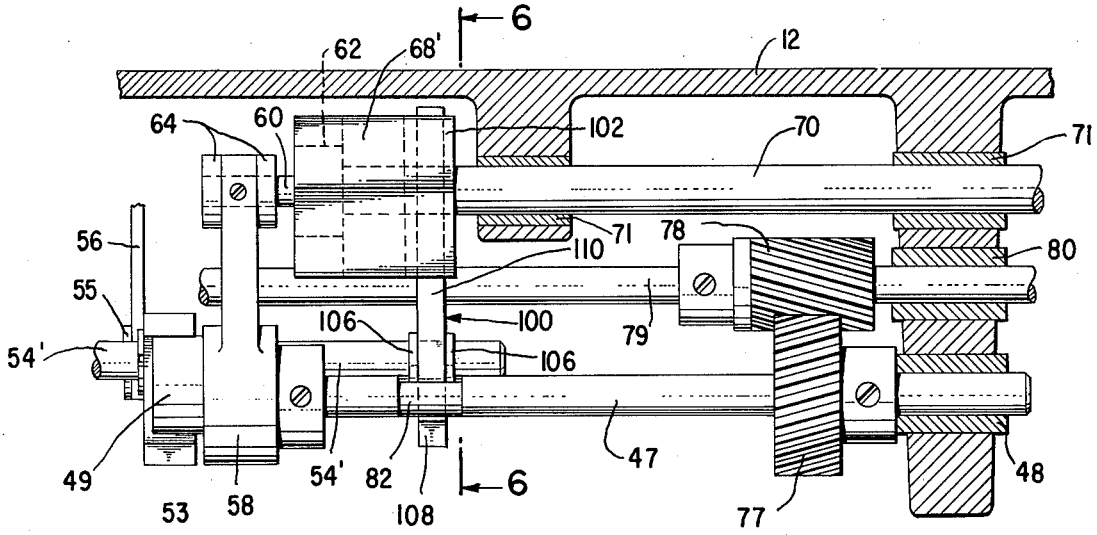
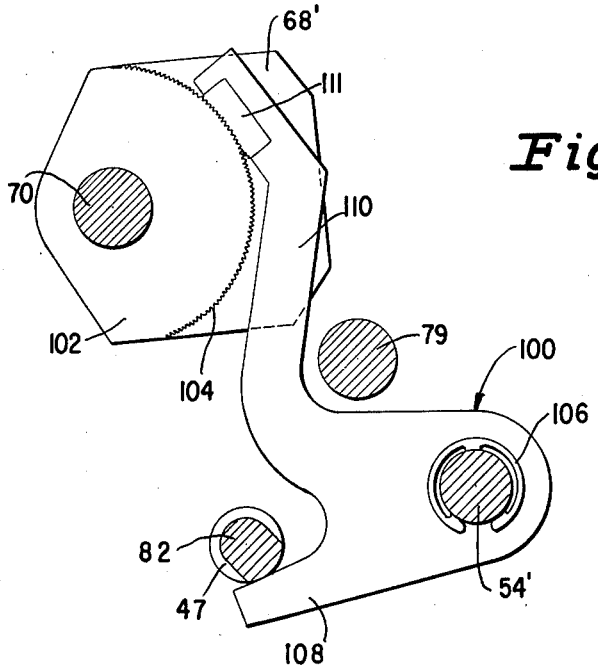
Fig. 6

FEED REGULATOR LOCKS

BACKGROUND OF THE INVENTION

The invention is concerned with an improvement for a feed regulator for a sewing machine; more particularly, with a device to restrict the movement of a feed regulator while the transport of a work material is being effected.

In the prior art there are many examples of sewing machines having feed systems utilizing one or another form of feed regulator to permit adjustment of stitch length. In the bulk of these prior art feed systems it has been noted that an undue loading of the feed system, for example, by stitching on a heavy work material or by applying tension to the work material, can result in temporary or permanent repositioning of the feed regulator by the feedback of forces to the regulator through the feeding dogs.

In those machines where the position of the feed regulator is controlled by means of a manually variable cam or by a work patterning cam, the feed back of forces through the feeding dog can be controlled by means of a spring acting on the feed regulator in a fashion to press the cam followers against the cams. Thus the feedback forces are compensated for to the extent of the force exerted by the spring. Problems have been encountered in those sewing machines having provisions for quick reverse through a depressible control in that a spring force which may be appreciable must be overcome; and in those sewing machines having a work patterning cam in that a cam material is required which is sufficient to withstand the spring force.

What is required is a device which may be incorporated in a feed system, which is not effected by feedback of forces through the feeding dog without the necessity for spring bias forces, and the adverse results thereof, heretofore required.

SUMMARY OF THE INVENTION

The above requirement is achieved simply and economically in a preferred embodiment in which a brake member is affixed to a shaft which also supports a feed regulator for the feed system. A shiftable member straddles both the shaft supporting the feed regulator and the brake member, and extends also to straddle a feed shaft which supports feed lift and feed advance cams for the feed system. An interposer slidably carried by the shiftable member abuts a radially functioning cam supported on, or part of, the feed shaft, thereby to move the interposer towards the shaft supporting the feed regulator in timed relation to feed lift by the feed lift cam. A screw carried by the interposer abuts the shiftable member, whereby the shiftable member is placed into intimate contact with the brake member also in timed relation to feed lift by the feed lift cam to inhibit further movement of the brake member and feed regulator during feed advance. The screw carried by the interposer provides the capability for adjustment of the degree of pressure between the shiftable and brake members.

In a second embodiment, a bell crank pivoted on the sewing machine frame has a first arm thereof in contact with the radially functioning cam on the feed shaft, and the second arm thereof in contact with a brake member affixed to a shaft which also supports the feed regulator. The brake member, ideally, may be implimented by a semi-circular machined surface on the feed regulator itself.

DESCRIPTION OF THE DRAWINGS

In order that the invention may be more fully understood it will now be described with reference to the accompanying drawings in which:

FIG. 5 is a front elevation similar to FIG. 3 of a second embodiment of the invention; and, FIG. 6 is a side elevation of the second embodiment taken along line 6—6 of FIG. 5.

BODY OF THE SPECIFICATION

Figure 1:
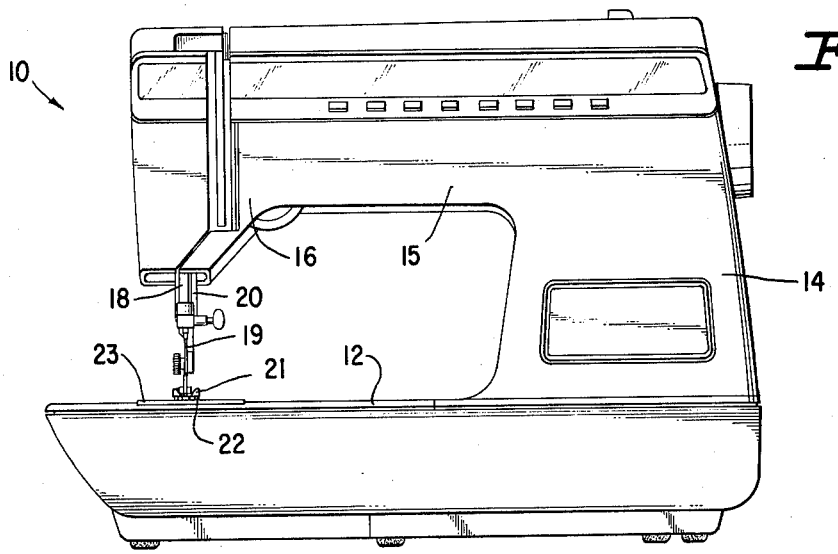
FIG. 1 is a elevation of a sewing machine in which the invention may be incorporated.

Referring to FIG. 1 there is shown a sewing machine 10 within which the invention finds utility. The sewing machine 10 includes a bed 12, from one end of which rises a standard 14 supporting a bracket arm 15 and a head portion 16 in overlying relationship to the bed. Supported within the head portion 16 for end wise reciproction and lateral ocillation by means of instrumentalities not shown but well known in the sewing machine art is a needle bar 18 terminating in sewing needle 19. Also supported in the head portion 16 behind the needle bar 18 is a presser bar 20 terminating in a presser foot 21 which is also supported therein by instrumentalities well known in the sewing machine art. The sewing needle 19 cooperates with sewing instrumentalities located within the bed 12 of the sewing machine 10 in the formation of sewing stitches in any manner which is well known in the sewing art. The presser foot 21 is urged by any of many well known instrumentalities against a feed dog 22, protruding through slots in a throat plate 23 and part of a feed system supported within the bed 12 of the sewing machine 10.

Figure 2:
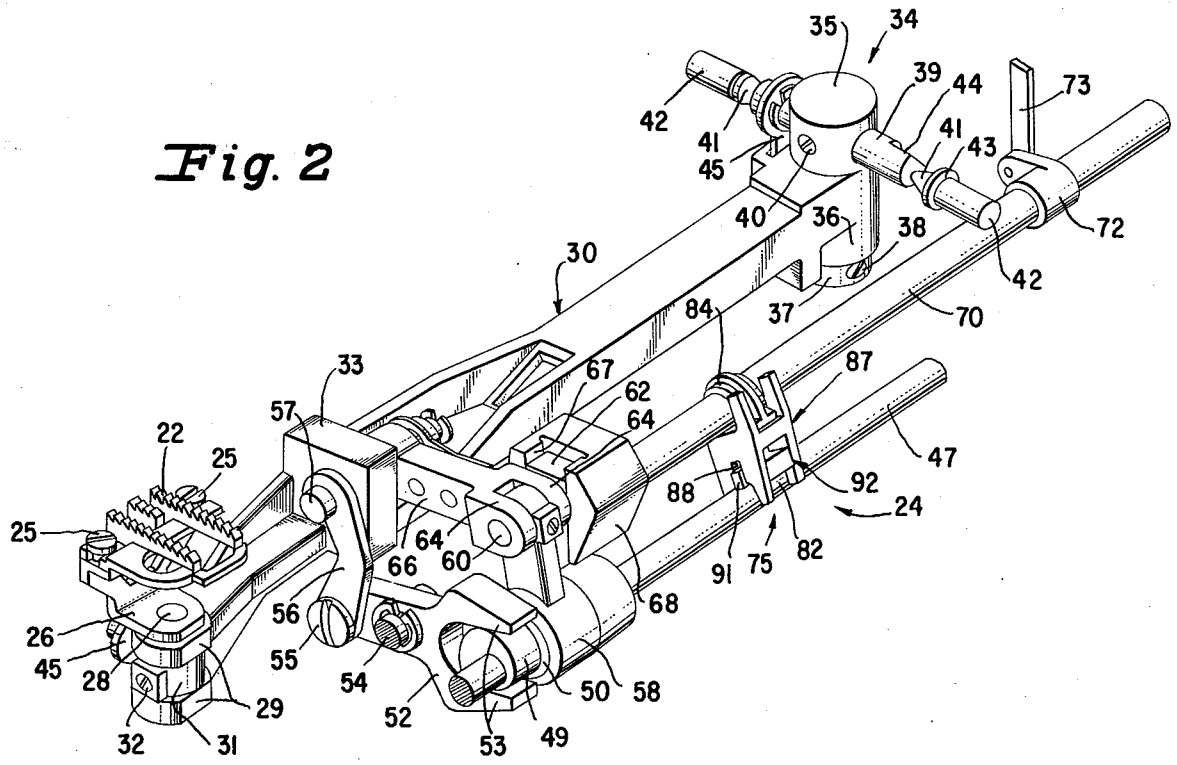
FIG. 2 is a perspective view of a feed system in the bed of the sewing machine of FIG. 1 which includes a preferred embodiment of the invention.

Referring to FIG. 2 there is shown a feed system 24, one of a variety of possible feed systems which may incorporate the invention. The feed dog 22 is secured by screws 25 to a feed dog carrier 26 which is fixed upon a pivot pin 28. The pivot pin 28 is journaled freely in bifurcations 29 formed at one extremity of an elongated feed bar 30. A collar 31 encircles the pivot pin 28 between the bifurcations 29 and is affixed to, the pivot pin by screw 32, thereby rotating with the pivot pin and retaining the feed dog carrier 26 within the bifurcations. The feed bar 30 extends laterally within the sewing machine bed 12 and at the extremity opposite the bifurcations 29, the feed bar is supported relatively to the bed in gimbals indicated generally at 34.

The gimbals 34 comprise a vertical pin having an enlarged head 35, on which pin an enlargement 36 formed on the extremity of feed bar 30 is freely journaled and sustained by a collar 37 secured by a set screw 38 extending to the vertical pin. The enlarged head 35 of the vertical pin is formed with a transverse bore accommodating a cylindrical trunnion pin 39. The trunnion pin 39 is formed with an annular groove (not visible) which accommodates a set screw 40 threaded in the enlarged head 35 of the vertical pin and serving to lock the trunnion pin relatively to the enlarged head. At each extremity, the trunnion pin 39 is formed with conical seats 41 arranged eccentrically of the axis of the trunnion pin. The conical seats 41 at both sides of the trunnion pin 39 are engaged by conical pintals 42 slidably disposed in bores in the bed 12, one of which is retained against a stop defined by snap ring 43 seated in an annular groove in the pintle. The trunnion pin 39 is preferrably formed with a flat 44 so that it may be engaged by a wrench or the like, and, upon loosening of the set screw 40, the trunnion pin may be turned on the pintles 42 whereupon, by virtue of the eccentricity of the pintle seats 41, the position of the feed dog 22 may be shifted laterally relative to the bed 12 to align the rows of teeth of the feed dog in the feed dog slots of the throat plate 23.

Thus the feed dog 22 connected to one extremity of the feed bar 30 may undergo up and down motion pivotal motion about conical pintles 42, and back and forth oscillation about the vertical pin with the enlarged head 35. Partially visible is an anchor link 45 which extends from a groove in the trunnion pin 39 to the opposite extremity of the feed bar to be connected to the collar 31 fixed to the pivot pin 28. Thus is created a parallelogram arrangement of the anchor link 45 and feed bar 30 which serves to maintain a for and aft alignment of the feed dog 22 for all position of oscillation of the feed bar about the vertical pin with the enlarged head 35. Further particulars on the feed system shown may be obtained by reference to the U.S. Pat. No. 3,527,183, assigned to the same assignee as the instant invention, which is hereby incorporated by reference and made a part of this application.

Figure 4:
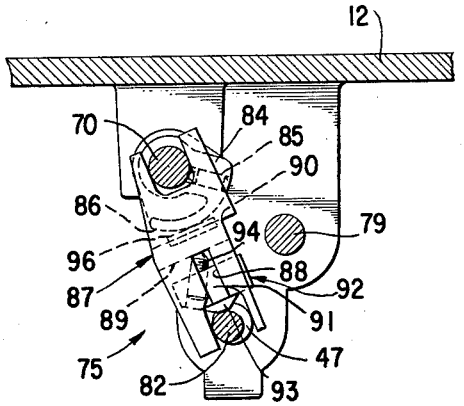
FIG. 4 is a side elevation of the invention taken along line 4—4 of FIG. 3.

Forward of the feed bar 30 is a feed shaft 47 journaled in bearings 48 (See FIG. 3) within the sewing machine bed 12. At one extremity of the feed shaft 47 is triangular lift cam 49 and an advance eccentric 50. A feed fork 52 is pivoted on a stud 54 attached to the sewing machine bed 12. The tines 53 of the feed fork 52 span the lift cam 49. The extremity of the feed fork 52 opposite the tines 53 is connected by shouldered screw 55 to a connecting link 56 which is attached to a pin 57 carried by a boss 33 on the feed bar 30. One end of a connecting rod 58 encircles the advance eccentric 50. The other end of the connecting rod 58 encircles a pin 60 within a clevise 64 on one extremity of a link 66. The extremity of the link 66 opposite the clevis 64 is carried in a ball and socket arrangement (not shown) on the extremity of the pin 57 protruding through the boss 33 of the feed bar 30. The pin 60 is attached to a slide block 62. The slide block 62 is carried in a slot 67 in a feed regulator 68, which is itself carried by a feed regulator shaft 70 journaled in bearings 71 (see FIG. 5) within the sewing machine bed 12 to be actuated by a lever 72 affixed to the feed regulator shaft and the link 73 pivotably connected thereto and extending to manual or automatic actuating means. Extending between the feed shaft 47 and the feed regulator shaft 70 is a feed regulator shaft lock arrangement 75 more clearly depicted in FIGS. 3 and 4.

Figure 3:
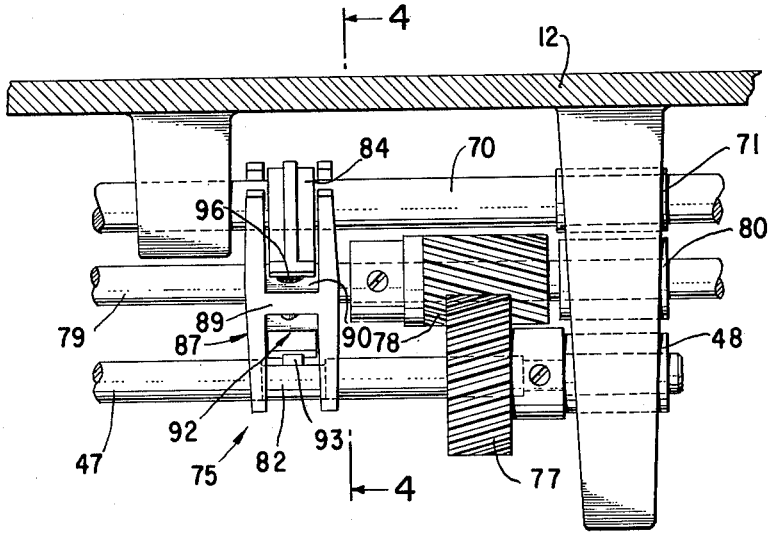
FIG. 3 is a front elevation of a portion of the bed of the sewing machine in FIG. 1 showing the preferred embodiment of the invention in greater detail.

In FIG. 3, a partial frontal elevation of the feed system 24 shown in FIG. 2, there is visible the feed regulator shaft 70, and feed shaft 47 supporting helical gear 77 in mesh with a drive helical gear 78 supported on a hook drive shaft 79 carried by bearings 80 affixed in the sewing bed 12 of the sewing machine. A sewing machine hook (not shown) is driven by the hook drive shaft 79 at a speed which is a multiple of needle bar 18 endwise reciprocation rate. The ratio of the drive helical gear 78 to the helical gear 77 is chosen so that the feed shaft 47 will rotate at the same speed as the needle bar 18 endwise reciprocation rate. Thus the fore and aft and up and down movement of the feed dog 22 effected by the advance eccentric 50 and the lift cam 49 will be at the same rate as the needle bar 18 endwise reciprocation. The feed shaft 47 is formed with a groove on one side thereof forming an eccentric portion 82 having a center off-set from the center of the feed shaft. A brake member 84 is affixed by screw 85 to the feed regulator shaft 70 opposite the eccentric portion 82 of the feed shaft 47. A shiftable member 87 extends from the feed regulator shaft 70 to the feed shaft 47 in straddling arrangement to both shafts, and is formed with a cavity from the upper end receiving the brake member 84, and a cavity from the lower end receiving an interposer 92, the interposer having lugs 91 on either side thereof extending into slots 88 in the sides of the shiftable member 87, the upper cavity and the lower cavity being separated by a solid portion 89. The interposer 92 has a raised section 93 in contact with the eccentric portion 82 of the feed shaft 47. The interposer 92 is further formed with a threaded hole receiving a screw 94 which may be extended to impinge on the solid portion 89 of the shiftable member 87 from the lower cavity thereof. The solid portion 89 of the shiftable member 87 carries at the base 90 of the upper cavity thereof a pad 96, ideally formed of urethane or other elastomeric material.

The operation of the feed regulator shaft locking arrangement 75 is as follows; the feed lift cam 49 may be arranged on the feed shaft 47 such that as feed lift begins to occur the throw of the eccentric portion 82 of the feed shaft will begin to extend towards the feed regulator shaft 70. The abutment of the eccentric portion 82 of the feed shaft 47 against the raised section 93 of the interposer 92 will cause it and, by suitable adjustment of screw 94 impinging on solid portion 89 of the shiftable member 87, the shiftable member to move towards the feed regulator shaft 70. Thus, the pad 96 will begin to impinge against an outer surface 86 of the brake member 84. By proper adjustment of the feed lift cam 49 to the eccentric portion 82 of the feed shaft 47, and of the screw 94 carried by interposer 92, movement of the feed regulator shaft 70 and thereby the feed regulator 68 will be inhibited by contact of the pad 96 with the bottom surface 86 of the brake member 84 as the feed dog 22 protrudes through the throat plate 23 and urges a work material in a feed advance motion. The outer surface 86 of the brake member 84 may be serrated, grooved or otherwise treated so that the pad 96 of the shiftable member 87 may obtain a firmer grip on the outer surface for a more effective inhibition of movement thereof. It is apparent that the outer surface 86 of the brake member 84 and the base 90 of the upper cavity of the shiftable member 87 may be treated in other ways equally effective to retard relative motion therebetween as for example, by a series of fine serrations on the surface 86 and on the base 90.

In FIGS. 5 and 6 is shown a second embodiment of a feed regulator shaft lock. FIG. 5 is a view similar to FIG. 3 however extended further to include some parts of the feed system 24. Thus is shown in FIG. 5 the lift cam 49 extending to the advance eccentric 50, the tines 53 of the feed fork 52, the connecting link 56 extending towards the boss 33 on the feed bar 30, the connecting rod 58 encircling the advance eccentric 50 and extending to the pin 60 connected to the slide block 62, the feed shaft 47, the feed regulator shaft 70 and the hook drive shaft 79. Also visible in FIG. 5 is a modified feed regulator 68', an elongated pivot stud 54' for the feed fork 52, and a bell crank 100 pivoted on the extended portion of the pivot stud 54'. The feed regulator 68' is modified by having an extension 102 thereto, which extension is formed with a serrated curved outer surface 104 equi-distant from the center of the rotation of the feed regulator. The bell crank 100 is freely rotatable on the elongated pivot stud 54' and held in position thereon by snap rings 106. The bell crank 100 is positioned to have one arm 108 thereof in contact with the eccentric portion 82 of the feed shaft 47. The second arm 110 of the bell crank extends adjacent the serrated outer surface 104 of the modified feed regulator 68'. The portion of the second arm 110 of the bell crank 100 adjacent the serrated outer surface 104 of the feed regulator 68' may have as an insert thereto a pad 111, ideally formed of urethane or other elastomeric material. Thus as in the prior embodiment when the feed lift cam 53 is suitably adjusted with respect to the eccentric portion 82 of the feed shaft 47, the eccentric portion 82 of the feed shaft 47 will impinge upon the first arm 108 of the bell crank 100, and cause the second arm 110 thereof and pad 111 carried thereon to engage the serrated outer surface 104 of the modified feed regulator 68' when the feed dog 22 protrudes through the throat plate 23, for the purpose of inhibiting spurious rotation of the feed regulator 68' due to feedback of forces through the feed dog.

Having thus set forth the nature of the invention what is claimed is:

1. A work feed system for a sewing machine having a frame including a work supporting bed housing said feed system, a throat plate carried by said work supporting bed and having a feed dog accommodating slot therein, said feed system including a feed dog having a work supporting rib arranged in said feed dog accommodating slot of said throat plate, a feed shaft, a feed lift cam supported on said feed shaft for alternately raising and lowering said feed dog to and from a work advancing position with said work supporting rib extending through said feed dog accommodating slot, a feed regulator shaft, a regulator affixed to said feed regulator shaft for selectively varying the direction and rate of work advance movement, means for rotating said feed regulator shaft for selective variation of the direction and rate of said work advance movement, wherein the improvement comprises:

a radially functioning camming device on said feed shaft operating in synchronism with said feed lift cam; a brake member affixed to said feed regulator shaft; and shiftable means extending in a plane transverse to said feed shaft between said camming device and said brake member and responsive to said camming device during said raising of said feed dog to said work advancing position for inhibiting movement of said brake member and said feed regulator.

2. A work feed system as claimed in claim 1 wherein said shiftable means includes a member straddling said feed regulator shaft and said brake member affixed to said feed regulator shaft for selective interference therewith, and extends to said feed shaft also in straddling relation thereto and to said camming device thereon, said member having a part thereof in contact with said camming device thereby to urge said member into said selective interference with said brake member, whereby further movement of said brake member is inhibited.

3. A work feed system as claimed in claim 2 wherein said part is implemented by an interposer carried by said member, said interposer having a cam follower portion in contact with said camming device and a variably extendable portion abutting said member for adjusting the interference between said shiftable member and said brake member.

4. A work feed system as claimed in claim 1 wherein said shiftable means includes a bell crank pivotably supported in said work supporting bed and having a first arm thereof in contact with said camming device and a second arm thereof in selective contact with a brake member for inhibiting movement thereof as urged by said camming device.

* * * * *